United States Patent [19]

Koritala

[11] 4,273,722

[45] Jun. 16, 1981

[54] METHOD OF ENHANCING ACTIVITY OF HOMOGENEOUS ZIEGLER-TYPE COPPER CATALYSTS

[75] Inventor: Sambasivarao Koritala, Peoria, Ill.

[73] Assignee: The United States of America as represented by the Secretary of Agriculture, Washington, D.C.

[21] Appl. No.: 176,235

[22] Filed: Aug. 8, 1980

[51] Int. Cl.[3] ..... C11C 3/12
[52] U.S. Cl. ..... 260/409
[58] Field of Search ..... 260/409

[56] References Cited

U.S. PATENT DOCUMENTS

| | | | |
|---|---|---|---|
| 3,278,568 | 10/1966 | deJonge et al. | 260/409 |
| 3,743,662 | 7/1973 | Eurlings et al. | 260/409 |
| 3,749,681 | 7/1973 | Koritala | 260/409 |
| 4,038,295 | 7/1977 | Stern et al. | 260/409 |

*Primary Examiner*—John F. Niebling
*Attorney, Agent, or Firm*—M. Howard Silverstein; David G. McConnell; Curtis P. Ribando

[57] ABSTRACT

In the hydrogenaton of a polyunsaturated oil, the activity of a homogeneous Ziegler-type copper catalyst is enhanced by the physical presence of an autonomous insoluble material.

8 Claims, No Drawings

METHOD OF ENHANCING ACTIVITY OF HOMOGENEOUS ZIEGLER-TYPE COPPER CATALYSTS

BACKGROUND OF THE INVENTION

1. Field of the Invention

The acceptability of polyunsaturated oils in many commercial applications, particularly in the food industry, requires the reduction of the polyenes to a more stable monoene or diene stage. For example, the stability of soybean oil as it relates to flavor reversion can be vastly improved by eliminating the linolenate, which exists at a level of about 6 to 9% in the natural oil. This is preferably accomplished by selectively hydrogenating the oil in order to reduce the proportion of linolenate without a concurrent increase in the level of saturates. In a commerical operation, the ideal catalyst for promoting such hydrogenations is one which is not only selective, but also highly active so as to minimize the duration of the reaction. This invention relates to a novel catalyst system for the rapid, partial hydrogenation of polyunsaturated oils.

2. Description of the Prior Art

Two basic catalytic systems have developed widespread acceptance in the selective hydrogenation of natural oils: insoluble catalysts and homogeneous catalysts. Insoluble types include those which have been supported on an inert carrier by adsorption, ion exchange, or precipitation, as well as those which have been coprecipitated with a suitable agent. Exemplary supported catalysts are taught in de Jonge et al., U.S. Pat. No. 3,278,568 wherein elemental copper, or copper compounds are dispersed on a variety of carriers including activated clay, diatomaceous earth, silica gel, and several metallic oxides. Koritala [J. Amer. Oil Chem. Soc. 45(3): 197–200 (1968)] and U.S. Pat. No. 3,515,678 teach supporting copper catalysts by precipitation onto micronized silica or alumina, and by exchange onto molecular sieve zeolites. In U.S. Pat. No. 3,749,681, Koritala shows adsorbing copper ammonium complex onto a microspheroidal silica gel. A coprecipitated catalyst is disclosed in Koritala, U.S. Pat. No. 4,174,300 wherein sodium silicate is reacted with a water-soluble copper salt to form a precipitate which is subsequently vacuum dried and heat treated. While insoluble catalysts tend to be characterized by high selectivities, their activities are often insufficient for practical commercial application.

The potential of soluble or homogeneous catalysts in the hydrogenation of polyunsaturated oils has been extensively studied in recent years. By virtue of being in the same phase as the oil, they have the inherent advantage of possessing more activity than their insoluble counterparts. While there are many types of homogeneous catalysts, one which is acceptably selective and moderately active is the Ziegler-type catalyst as described by R. Stern et al. in U.S. Pat. No. 4,038,295. These are composed of transition metal salts in combination with a reducing agent, as exemplified by copper stearate-triethylaluminum.

SUMMARY OF THE INVENTION

I have now unexpectedly discovered that when a polyunsaturated oil is hydrogenated with a homogeneous Ziegler-type copper catalyst in the presence of an insoluble material selected from the group consisting of alumina, silica, alumina-silica, siliceous clays, and titanium dioxide, the activity of the catalyst is substantially increased beyond the activity exhibited by the homogeneous system alone.

Hydrogenations conducted in accordance with the invention will proceed at a rate up to about five times faster than those catalyzed by a corresponding Ziegler-type catalyst without the presence of the insoluble material, with the selectivities being substantially unaffected. While the mechanism of operation is not understood, these results are surprising in light of both theory and knowledge of existing prior art systems. From all outward appearances, the catalysts used in accordance with the invention remain soluble in the oil, and would thereby be expected to promote hydrogenations at the same rate as conventional homogeneous systems. If on the other hand the added insoluble materials were in fact acting as supports, then the catalysts would tend to be insolubilized with a concurrent reduction in their activities.

DETAILED DESCRIPTION OF THE INVENTION

Oils which may be hydrogenated by the instant method include any of the higher polyunsaturated oils, and of particular interest are the edible, linoleate-containing vegetable oils such as soybean oil, rapeseed oil, linseed oil, and the like. For the most part, these oils may be either crude or refined, provided that they do not contain impurities which would poison the catalyst.

The homogeneous Ziegler-type copper catalysts useful herein are well known in the art and comprise a copper salt in combination with an organometallic reducing agent. The anion associated with the copper is preferably stearate, palmitate, oleate, or other entity already present in the oil, thereby insuring solubility of the salt. Suitable organometallic reducing agents without limitation thereto are triethylaluminum, tributylaluminum, triisobutylaluminum, diethyl magnesium, and the like. These catalysts may be prepared by any conventional method such as that taught in Stern et al., supra.

The conditions for conducting the hydrogenation are well known in the art and do not constitute part of the invention. However, generally the amount of catalyst will range from about 0.01 to about 1% expressed as the weight of copper/weight of oil. The hydrogen pressure should be in the range of about 30 to 1000 p.s.i.g. Temperatures will typically be in the range of about 50°–300° C.

The advantages of the invention are realized by conducting the hydrogenation in the presence of an effective amount of insoluble material which exists in the reaction medium as an autonomous component. That is, the material does not support the catalyst in the traditional sense of having had it adsorbed, exchanged, precipitated, or otherwise attached thereon by any conventional procedure. The preferred insoluble material is alumina, while others which I have found to be operable include silica, aluminasilica, siliceous clays, and titanium dioxide. The term "effective amount" as used herein is intended to mean any amount which will increase the activity of the conventional Ziegler catalyst. This can be readily determined by a person in the art by observing the respective rates of hydrogenation in parallel reactions with and without the insoluble material. Generally, optimum activities are imparted to the catalysts by amounts of insoluble material in the range of 0.5–5% based on the weight of the oil. The material is simply added to the reaction medium prior to the hydrogenation and can subsequently be recovered by filtration. It is envisioned that this method would be equally operative in either a batch or continuous hydrogenation.

The following examples are intended only to further illustrate the invention and are not intended to limit the scope of the invention which is defined by the claims.

EXAMPLE 1

Seventy-five grams of refined and bleached soybean oil was placed under a nitrogen blanket in an Erlenmeyer flask with a side arm. After heating the oil to 60°–70° C., the flask was evacuated to expel dissolved moisture and air. Copper stearate (0.743 g., 0.1% copper based on the weight of the soybean oil) and 0.75 g. of "ALON C" ($Al_2O_3$) were added with stirring while 3 ml. of a 25% solution of triethylaluminum in heptane was added through the septum of the side arm. The oil and catalyst mixture was then transferred into a 150-ml. Magna Dash Converter with nitrogen pressure. When the reaction temperature of 170° C. was reached, the nitrogen was vented to the atmosphere and hydrogen gas admitted to 150 p.s.i.a. The stirrer was started to initiate the reaction. The reaction was terminated after a predetermined amount of hydrogen was consumed. The oil was analyzed by gas-liquid chromatography (GLC) of the methyl esters. The results are reported in Table I, below. For purposes of comparison, analysis of the starting oil is given together with a control run in which the Ziegler-type catalyst was used without the alumina. The extent of reaction is manifest by the decrease in iodine value as compared to the starting material, while the relative activities are indicated by the reaction times.

EXAMPLE 2

The procedure of Example 1 was repeated except the amount of copper stearate was adjusted so as to constitute 0.025% copper based on the weight of the soybean oil, and diethyl magnesium was substituted for the triethylaluminum as the organometallic reducing agent. Three runs were conducted: (1) without an insoluble material; (2) with "CAB-O-SIL," a form of silica ($SiO_2$); and (3) with "CAB-O-TICA," a form of titanium dioxide ($TiO_2$). The results are reported in Table II, below.

It is understood that the foregoing detailed description is given merely by way of illustration and that modification and variations may be made therein without departing from the spirit and scope of the invention.

TABLE I

| | Starting material | Hydrogenated products Catalyst | |
|---|---|---|---|
| | | Cu—TEAL | Cu—TEAL + $Al_2O_3$ |
| Methyl palmitate | 10.2 | 10.2 | 10.0 |
| Methyl stearate | 3.9 | 6.7 | 5.2 |
| Methyl oleate | 21.1 | 55.3 | 57.8 |
| Methyl linoleate | 56.7 | 27.3 | 26.5 |
| Methyl linolenate | 8.1 | 0.5 | 0.5 |
| % trans isomers[a] | — | 24.8 | 28.5 |
| $K_{Le}/K_{Lo}$[b] | — | 3.1 | 3.0 |
| Iodine value[c] | 137.5 | 96.2 | 96.9 |
| Reaction time (min.) | 0 | 98 | 20 |

[a]Higher-melting unsaturated esters.
[b]The ratio of the rate of reaction of linolenate ($K_{Le}$) over the rate of reaction of linoleate ($K_{Lo}$) is used as an indicator of selectivity.
[c]Computed from GLC values.

TABLE II

| | Starting material | Hydrogenated products Catalyst | | |
|---|---|---|---|---|
| | | Cu-DEMG | Cu-DEMG + $SiO_2$ | Cu-DEMG + $TiO_2$ |
| Methyl palmitate | 10.2 | 10.6 | 10.2 | 10.4 |
| Methyl stearate | 3.9 | 5.7 | 5.8 | 5.2 |
| Methyl oleate | 21.1 | 52.0 | 57.1 | 49.4 |
| Methyl linoleate | 56.7 | 31.4 | 26.2 | 33.8 |
| Methyl linolenate | 8.1 | 0.9 | 0.7 | 1.2 |
| % trans isomers[a] | — | 28.6 | 33.6 | 25.7 |
| $K_{Le}/K_{Lo}$[b] | — | 3.0 | 2.6 | 2.9 |
| Iodine value[c] | 137.5 | 101.5 | 96.3 | 104.2 |
| Reaction time (min.) | 0 | 87 | 61 | 31 |

[a]Higher-melting unsaturated esters.
[b]The ratio of the rate of reaction of linolenate ($K_{Le}$) over the rate of reaction of linoleate ($K_{Lo}$) is used as an indicator of selectivity.
[c]Computed from GLC values.

I claim:

1. In a method for hydrogenating polyunsaturated oil with a homogeneous Ziegler-type copper catalyst, the improvement comprising conducting said hydrogenation in the presence of an effective amount of an insoluble material selected from the group consisting of alumina, silica, alumina-silica, siliceous clays, and titanium dioxide.

2. The method as described in claim 1 wherein said oil is a linolenate-containing vegetable oil.

3. The method as described in claim 2 wherein said oil is soybean oil.

4. The method as described in claim 1 wherein said Ziegler-type catalyst is copper stearate-triethylaluminum.

5. The method as described in claim 1 wherein said Ziegler-type catalyst is copper stearate-diethyl magnesium.

6. The method as described in claim 1 wherein said insoluble material is alumina.

7. The method as described in claim 1 wherein said insoluble material is silica.

8. The method as described in claim 1 wherein said insoluble material is titanium dioxide.

* * * * *